US008605002B2

(12) United States Patent
Nishi et al.

(10) Patent No.: US 8,605,002 B2
(45) **Date of Patent: *Dec. 10, 2013**

(54) ANTENNA DEVICE INCLUDING HELICAL ANTENNA

(75) Inventors: Takafumi Nishi, Okazaki (JP); Akira Takaoka, Okazaki (JP); Shiro Koide, Kariya (JP); Ichiro Shigetomi, Nagoya (JP)

(73) Assignees: Denso Corporation, Kariya (JP); Nippon Soken, Inc., Nishio (JP)

( * ) Notice: Subject to any disclaimer, the term of this patent is extended or adjusted under 35 U.S.C. 154(b) by 516 days.

This patent is subject to a terminal disclaimer.

(21) Appl. No.: 12/932,521

(22) Filed: Feb. 28, 2011

(65) Prior Publication Data

US 2011/0215983 A1 Sep. 8, 2011

(30) Foreign Application Priority Data

Mar. 3, 2010 (JP) ..... 2010-47130

(51) Int. Cl.
*H01Q 1/40* (2006.01)

(52) U.S. Cl.
USPC ..... 343/873; 343/895; 343/702; 343/700 MS

(58) Field of Classification Search
USPC ..... 343/895, 702, 700 MS, 873
See application file for complete search history.

(56) References Cited

U.S. PATENT DOCUMENTS

| | | | | |
|---|---|---|---|---|
| 4,427,984 | A * | 1/1984 | Anderson | 343/764 |
| 5,345,248 | A * | 9/1994 | Hwang et al. | 343/895 |
| 5,798,737 | A | 8/1998 | Kanaba et al. | |
| 5,986,619 | A * | 11/1999 | Grybos et al. | 343/895 |
| 6,198,449 | B1 * | 3/2001 | Muhlhauser et al. | 343/753 |
| 6,243,052 | B1 * | 6/2001 | Goldstein et al. | 343/895 |
| 6,720,935 | B2 * | 4/2004 | Lamensdorf et al. | 343/895 |
| 6,778,149 | B2 * | 8/2004 | Fukae et al. | 343/895 |
| 7,215,298 | B1 * | 5/2007 | Fraschilla et al. | 343/853 |
| 7,567,216 | B2 * | 7/2009 | Takaoka et al. | 343/895 |
| 7,639,202 | B2 * | 12/2009 | Takaoka et al. | 343/895 |
| 2003/0164805 | A1 * | 9/2003 | Strickland | 343/895 |
| 2006/0290590 | A1 * | 12/2006 | Takaoka et al. | 343/895 |
| 2007/0200786 | A1 * | 8/2007 | Takaoka et al. | 343/895 |
| 2008/0204337 | A1 * | 8/2008 | Takaoka et al. | 343/722 |
| 2010/0182209 | A1 * | 7/2010 | Nishi et al. | 343/711 |

FOREIGN PATENT DOCUMENTS

| | | |
|---|---|---|
| JP | 8-078946 | 3/1996 |
| JP | 9-074307 | 3/1997 |

* cited by examiner

*Primary Examiner* — Douglas W Owens
*Assistant Examiner* — Jae Kim
(74) *Attorney, Agent, or Firm* — Harness, Dickey & Pierce, P.L.C.

(57) ABSTRACT

In an antenna device, a first helical part of a first antenna and a second helical part of a second antenna is disposed in a dielectric body on a ground plane. Each helical part is helically wound up in a direction perpendicular to the ground plane and includes a plurality of one-turn portions. Each one-turn portion of the first helical part has a peripheral length of M times a wavelength λ of use, where M is a positive natural number. One of the one-turn portions of the second helical part closest to the ground plane has a peripheral length Ks that is N times the wavelength λ of use, where N is a positive natural number greater than M. One of the one-turn portions of the second helical part farthest away from the ground plane has a peripheral length Ke, and $(M\cdot\lambda)<Ke<Ks$ $(=N\cdot\lambda)$.

7 Claims, 9 Drawing Sheets

ANTENNA DEVICE INCLUDING HELICAL ANTENNA

CROSS REFERENCE TO RELATED APPLICATIONS

The present application is based on and claims priority to Japanese Patent Application No. 2010-47130 filed on Mar. 3, 2010, the contents of which are incorporated in their entirety herein by reference.

BACKGROUND OF THE INVENTION

1. Field of the Invention

The present invention relates to an antenna device including a helical antenna.

2. Description of the Related Art

Conventionally, a helical antenna is widely used as a linear antenna that has a satisfactory circularly-polarized wave property.

When a helical antenna is used alone, a directivity control is difficult. Thus, JP-A-8-789946 discloses an antenna device having an array structure in which a plurality of helical antennas is arranged on a surface of a reflecting plate.

In the antenna device having the array structure, directivity is controlled while keeping a shape of an antenna beam. Therefore, the helical antennas need to be arranged at an interval of a half wavelength of use, and it is difficult to reduce a dimension of the antenna device.

SUMMARY OF THE INVENTION

In view of the foregoing problems, it is an object of the present invention to provide an antenna device that can have a small dimension and a broad band.

An antenna device according to an aspect of the present invention includes a ground plane, a dielectric body, a first antenna, a second antenna, and a feeding circuit. The ground plane has a surface, and the dielectric body is disposed on the surface of the ground plane. The first antenna includes a first helical part disposed in the dielectric body. The first helical part is helically wound up in an axial direction perpendicular to the surface of the ground plane. The first helical part includes a plurality of one-turn portions each having a peripheral length of M times a wavelength $\lambda$ of use, where M is a positive natural number. The second antenna includes a second helical part disposed in the dielectric body. The second helical part is disposed outside the first helical part in a direction perpendicular to the axial direction so as to be away from the first helical part. The first helical part is wound up along the axial direction. The feeding circuit includes an oscillator, a divider coupled with the oscillator, a first phase shifter coupled with the divider and a feeding point of the first antenna, and a second phase shifter coupled with the divider and a feeding point of the second antenna. The second helical part includes a plurality of one-turn portions. One of the one-turn portions of the second helical part closest to the surface of the ground plane has a peripheral length Ks that is N times the wavelength $\lambda$ of use, where N is a positive natural number greater than M. In consecutive two of the one-turn portions of the second helical part, a first one closer to the surface of the ground plane has a peripheral length K1, a second one farther away from the surface of the ground plane has a peripheral length K2, and the peripheral lengths K1 and K2 satisfy a relationship of $K1 \geq K2$. One of the plurality of one-turn portions of the second helical part farthest away from the surface of the ground plane has a peripheral length Ke that satisfies a relationship of $(M \cdot \lambda) < Ke < Ks (= N \cdot \lambda)$ In the antenna device, dimensions of the first antenna and the second antenna can be reduced due to a wavelength shortening effect of the dielectric body. Thus, the antenna device can have a small dimension. Furthermore, because the second helical part of the second antenna device has the above-described shape, the second antenna device can have a broader band compared with a case where a second helical part has a constant peripheral length.

BRIEF DESCRIPTION OF THE DRAWINGS

Additional objects and advantages of the present invention will be more readily apparent from the following detailed description of preferred embodiments when taken together with the accompanying drawings. In the drawings.

DETAILED DESCRIPTION OF THE PREFERRED EMBODIMENTS

A process that the inventors of the present application create the present invention will be described before describing preferred embodiments of the present invention.

Figure 1:
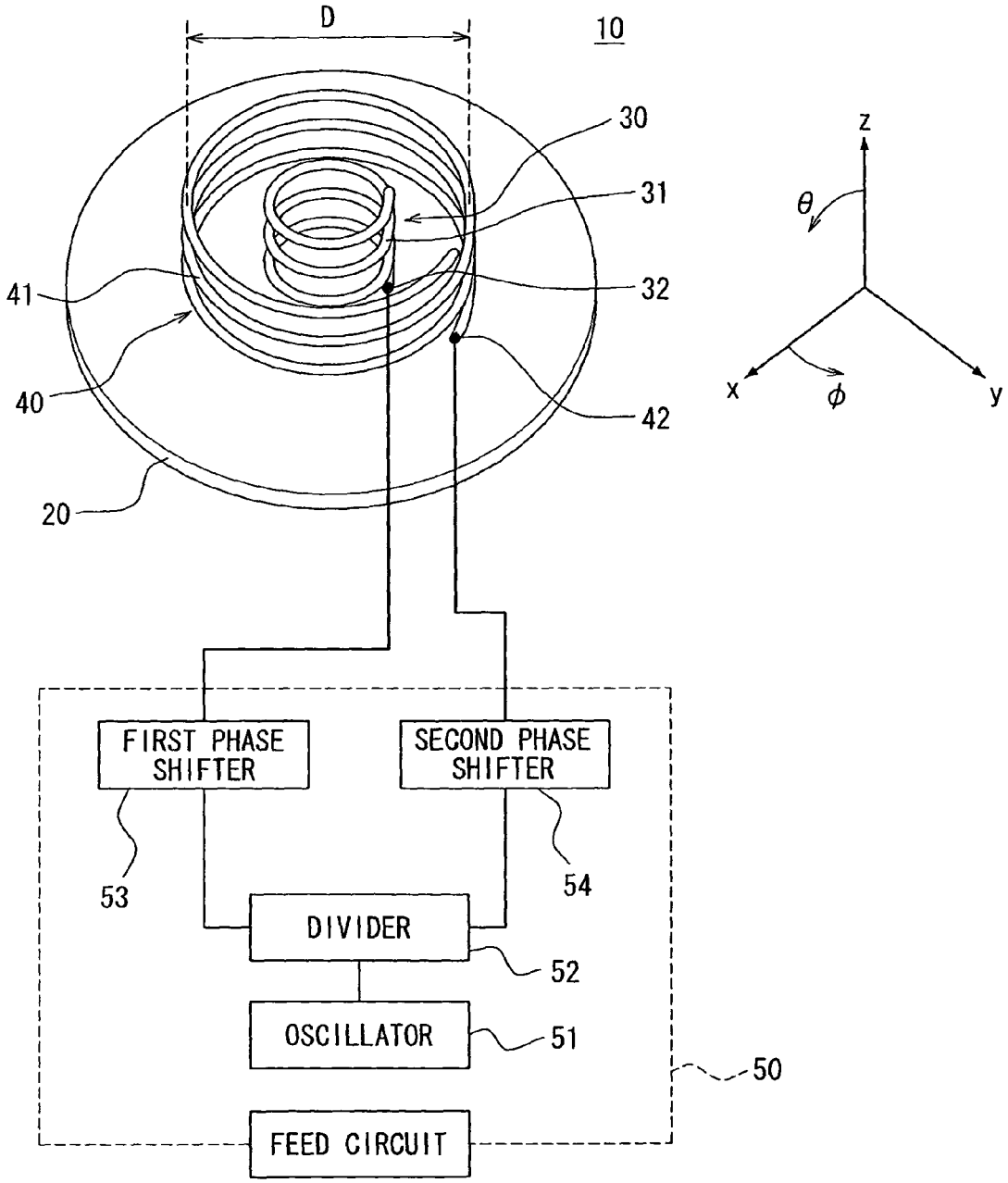
FIG. 1 is a diagram showing an antenna device according to a reference example.

FIG. 1 is a diagram showing an antenna device disclosed in Japanese Patent Application No. 2009-7545 filed on Jan. 16, 2009 (corresponding to U.S. patent application Ser. No. 12/655,814 filed on Jan. 7, 2010) by the present inventors. Two directions provided along a surface of a ground plane 20 on which helical parts 31 and 41 are disposed and bisecting at right angles are expressed as an x-axis direction and a y-axis direction. A thickness direction of the ground plane 20 is expressed as a z-axis direction. A rotational direction around the Z-axis is expressed as a $\phi$ direction, and a rotational direction around the y-axis is expressed as a $\theta$ direction.

Regarding lengths and directions of antennas 30 and 40 (helical parts 31 and 41) described below, an expression does not mean only an exact expression but also means a rough expression. For example, a description of "2 times" means about 2 times, and description of "vertical direction" means an approximately vertical direction.

The antenna device 10 shown in FIG. 1 includes two axial-mode helical antennas, that is, a first antenna 30 and a second antenna 40. The first antenna 30 extends in the vertical direction (the z-axis direction) to the surface of the ground plane 20. The first antenna 30 includes a first helical part 31. The first helical part 31 is wound up in such a manner that a peripheral length of each one-turn portion is constant and is P times a wavelength $\lambda$ of use, where P is a positive natural number. That is, an axial direction of the first helical part 31 is parallel to the z-axis direction.

The second antenna 40 has a second helical part 41. The second helical part 41 is arranged outside the first helical part 31 in a direction perpendicular to the axial direction (the z-axis direction) of the first helical part 31 so as to be away from the first helical part 31. The second helical part 41 extends along the axial direction (the z-axis direction) of the first helical part 31 and is wound up in such a manner that a peripheral length of each one-turn portion is constant and is Q times the wavelength $\lambda$ of use, where Q is a positive natural number greater than P.

Each of the first antenna 30 and the second antenna 40 is formed by winding up a wire in such a manner that a cross section perpendicular to the axial direction, that is, a plane shape of each one-turn portion being perpendicular to the axial direction has a circular shape. The second helical part 41 is disposed radially outside of the first helical part 31. In an example shown in FIG. 1, the peripheral length of each one-turn portion of the first helical part 31 is same as the wavelength $\lambda$ of use (P=1), and the peripheral length of each one-turn portion of the second helical part 41 is 2 times the wavelength $\lambda$ of use (Q=2). Thus, a diameter D of the second helical part 41 is $2\lambda/\pi$.

In the antenna device 10 shown in FIG. 1, the ground plane 20 has a plate shape having a predetermined thickness, and the surface has a circular shape. The first antenna 30 and the second antenna 40 are arranged in such a manner that the axis of the first helical part 31 of the first antenna 30 and the axis of the second helical part 41 of the second antenna 40 pass through a center of the surface of the ground plane 20. In other words, the first helical part 31 and the second helical part 41 are arranged approximately concentrically with respect to the center of the surface of the ground plane 20. Thus, in a direction perpendicular to the axial direction (the z-axis direction), a distance from the second helical part 41 of the second antenna 40 to an end portion of the ground plane 20 is substantially uniform in the whole circumference around the z-axis.

The antenna device 10 further includes a feed circuit 50 that supplies a high frequency signal to each of the first antenna 30 and the second antenna 40. The feed circuit 50 includes an oscillator 51, a divider 52, a first phase shifter 53, and a second phase shifter 54. The oscillator 51 generates the high frequency signal. The divider 52 is coupled with the oscillator 51 and divides the high frequency signal input from the oscillator 51. The divider 52 controls the strength of the high frequency signal (amplitude) input to each of the first phase shifter 53 and the second phase shifter 53. In other words, the divider 52 can optionally control the ratio of the strength of the high frequency signal input to each of the first antenna 30 and the second antenna 40.

The first phase shifter 53 and the second phase shifter 54 control the phase of the high frequency signal input from the divider 52. The first phase shifter 53 is coupled with a feeding point 32 of the first antenna 30. The second phase shifter 54 is coupled with the feeding point 42 of the second antenna 40. The first phase shifter 53 and the second phase shifter 54 control the phase difference of the high frequency signals input to the first antenna 30 and the second antenna 40.

The antenna device 10 having the above-described structure can activate the first antenna 30 and the second antenna 40 at the same time and can control the directivities of the main beam in the $\phi$ direction and the $\theta$ direction generated due to the interaction with the phases and the strengths of the high frequency signals input to the first antenna 30 and the second antenna 40. In addition, because the first helical part 31 is arranged inside the second helical part 41, a dimension of the antenna device 10 can be reduced although the antenna device 10 includes a plurality of antennas 30 and 40.

Details of a configuration and function effects of the antenna device 10 shown in FIG. 1 is described in Japanese Patent Application No. 2009-7545 (corresponding to U.S. patent application Ser. No. 12/655,814), detailed description will be omitted.

The inventors of the present application considered additional reduction of the dimension of the antenna device 10 by using a dielectric body. In an example shown in FIG. 2, a dielectric body 60 is arranged on the surface of the ground plane 20 in the antenna device 10 shown in FIG. 1, and the first helical part 31 of the first antenna 30 and the second helical part 41 of the second antenna 40 are disposed in the dielectric body 60.

Figure 2:
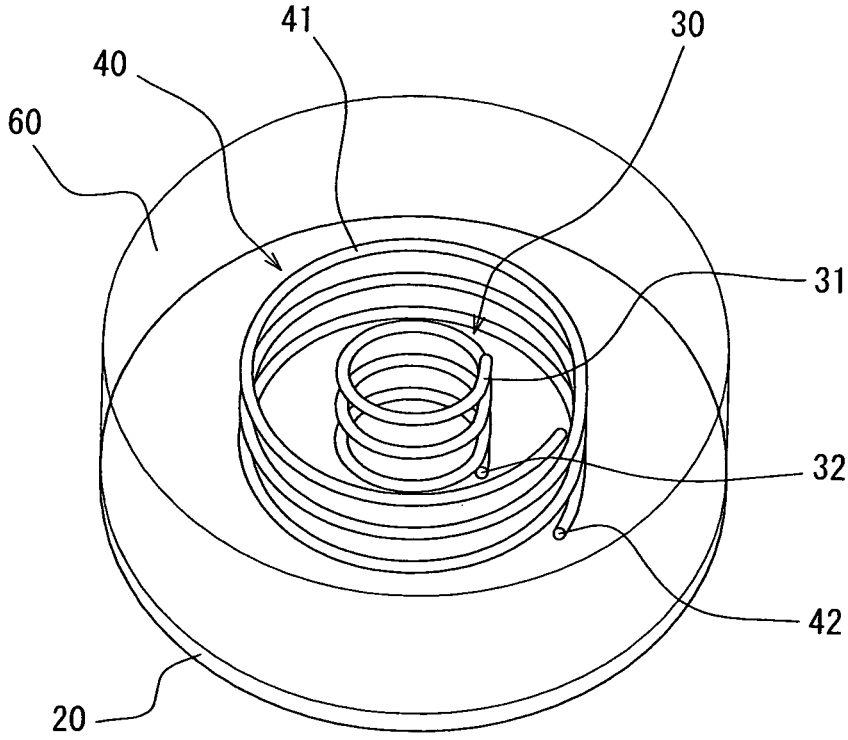
FIG. 2 is a diagram showing a part of an antenna device according to another reference example, in which a dielectric body is added to a configuration shown in FIG. 1.

In the example shown in FIG. 2, the dielectric body 60 has an approximately column shape having a predetermined thickness in the z-axis direction. In the direction perpendicular to the z-axis direction, the diameter of the dielectric body 60 is substantially, equal to the diameter of the surface of the ground plane 20. In other words, the dielectric body 60 is arranged so as to cover the whole area of the surface of the ground plane 20.

According to the study by the inventors, in a case where the first helical part 31 is disposed in the dielectric body 60 and the second helical part 41 is wound around the surface of the dielectric body 60, little wavelength shortening effect to the second antenna 40 is achieved. However, in a case where both of the first helical part 31 and the second helical part 41 are disposed in the dielectric body 60, the dimensions of the first antenna 30 and the second antenna 40, eventually, the dimension of the antenna device 10 can be reduced by the wavelength shortening effect of the dielectric body 60. In this case, the diameter D of the second helical part 41 is $2\lambda/(\pi\cdot\in^{1/2})$ (see FIG. 5).

Thus, in what follows, the configuration in which the helical parts 31 and 41 are disposed in the dielectric body 60 will be described.

Figure 3:
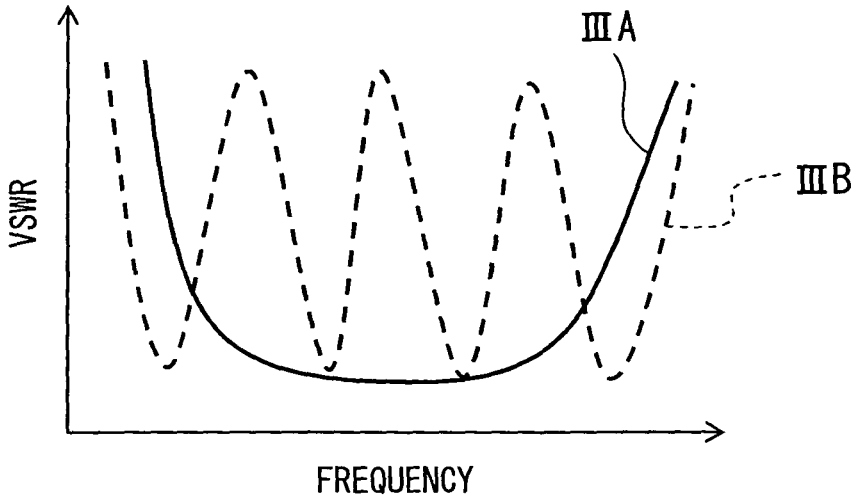
FIG. 3 is a graph showing relationships between a frequency and voltage standing wave ratios (VSWR) of the antenna devices shown in FIG. 1 and FIG. 2.

The inventors studied the band of the second antenna 40 in the antenna devices 10 shown in FIG. 1 and FIG. 2. In the configuration without the dielectric body 60 (configuration shown in FIG. 1), the second antenna 40 has a broad band property as shown by the solid line IIIA in FIG. 3. On the other hand, in the configuration with the dielectric body 60 (configuration shown in FIG. 2), the second antenna 40 has a narrow band property as shown by the dashed line IIIB in FIG. 3.

From a result of electromagnetic field simulation by the inventors, it seemed that the change in the band of the second antenna 40 depending on the presence or absence of the dielectric body 60 is caused by the following reasons.

Figure 4:
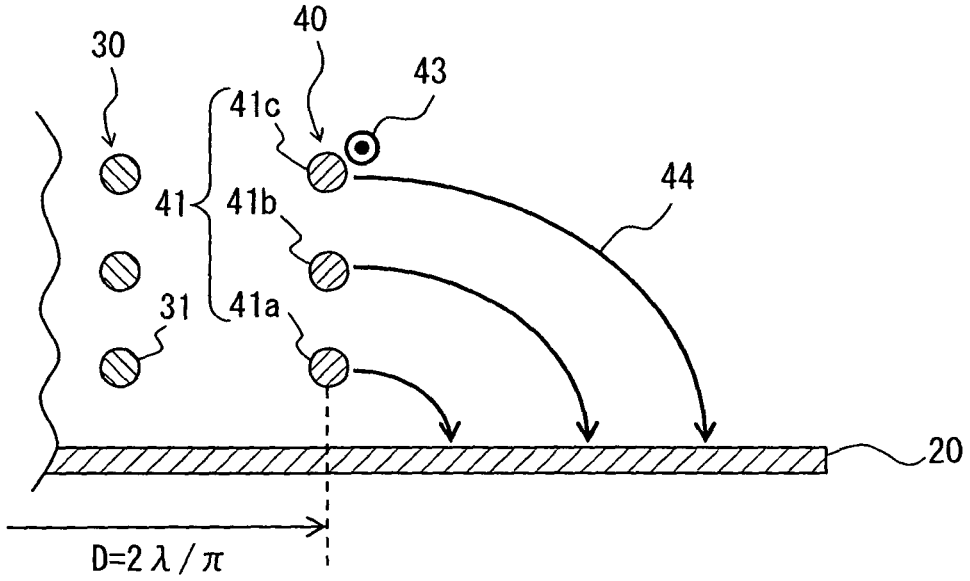
FIG. 4 is a schematic diagram showing an electric field generated at a second helical part in the antenna device shown in FIG. 1.

In the configuration without the dielectric body 60 (the configuration shown in FIG. 1), when the second antenna 40 operates, a traveling-wave current flows on the surface of the wire that forms the second antenna 40 from the feeding point 42 toward an opposite end. In other words, as shown in FIG. 4, the traveling-wave current 43 flows in the second helical part 41. Because the traveling-wave current 43 flows in the second antenna 40, the second antenna 40 operates as an axial-mode helical antenna, and thereby the second antenna 40 has the broad band property.

At this time, electric field is radiated from the traveling-wave current 43. A main electric field 44 radiated from the traveling-wave current 43 is shown by the solid arrows in FIG. 4. When three cross-sectional portions of the second helical part 41 shown in FIG. 4 are referred to as a first one-turn portion 41*a*, a second one-turn portion 41*b*, and a third one-turn portion 41*c* from a side close to the ground plane 20, the phases of the traveling-wave current 43 (high frequency current) at the first to third one-turn portions 41*a* to 41*c* have the same polarity. Thus, the main electric field 44 radiated from the traveling-wave current 43 flowing in each of the one-turn portions 41*a* to 41*c* is radiated toward a portion of the ground plane 20 away from each of the one-turn portions 41*a* to 41*c* in the direction perpendicular to the z-axis direction. In addition, in the second helical part 41, the farther away from the ground plane 20 the one-turn portion is located (for example, third one-turn portion 41*c*), the farther away the electric field 44 is radiated to in the direction perpendicular to the z-axis direction. In the electric field radiated from the traveling-wave current 43, only the main electric field 44 provided outside the second helical part 41 is illustrated in FIG. 4 for the sake of convenience.

Figure 5:
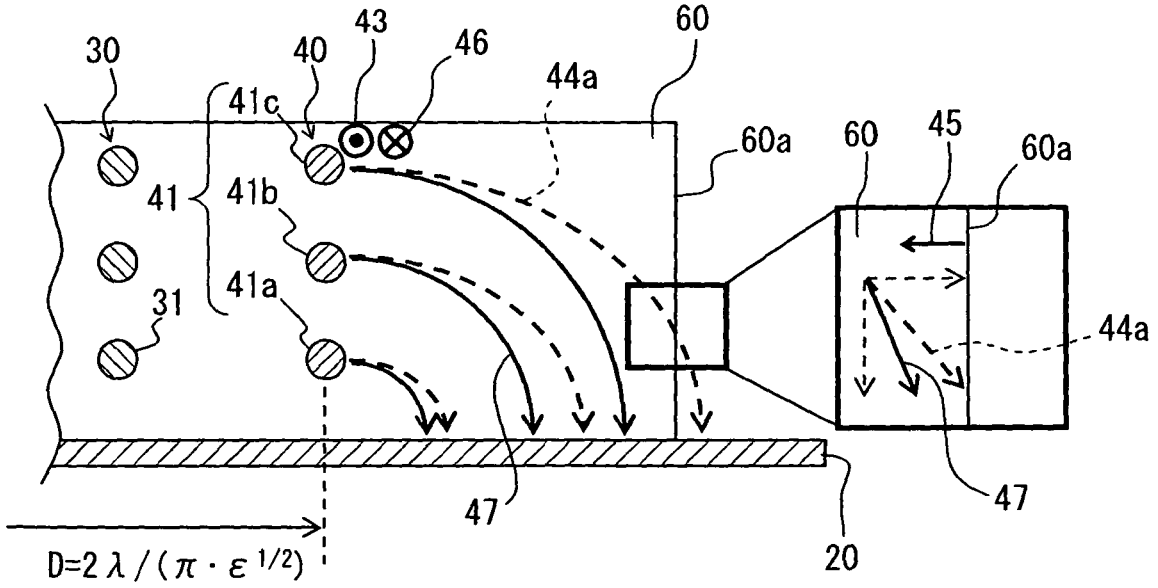
FIG. 5 is a schematic diagram showing an electric field generated at a second helical part in the antenna device shown in FIG. 2.

In the configuration with the dielectric body 60 (the configuration shown in FIG. 2), as shown in FIG. 5, when the traveling-wave current flows in the second antenna 40, electric field is radiated from the traveling-wave current 43 that flows in the second helical part 41. A main electric field 44*a* radiated from the traveling-wave current 43 is shown by the dashed arrows in FIG. 5. The electric field 44*a* is a hypothetical electric field with taking into account of only the traveling-wave current 43 in electric current that flows in the second helical part 41. If the traveling-wave current 43 is the same, the electric field 44*a* is the same as the electric field 44 in FIG. 4. In FIG. 5, a hatching that indicates the cross section of the dielectric body 60 is not illustrated to improve understanding of the electric fields 44*a* and 47 and the helical parts 31 and 41.

Because a medium of the dielectric body 60 is different from air in an external atmosphere, a part of the electric field 44*a* is reflected at a boundary between the dielectric body 60 and air, that is, a sidewall 60*a* of the dielectric body 60. Thus, a reflected wave 45 (reflected electric field) of the electric field 44*a* is generated in the dielectric body 60, and the reflected wave 45 causes a reflected-wave current 46 in the second helical part 41 in the second antenna 40. The reflected-wave current 46 flows in the opposite direction of the traveling-wave current 43, and thereby a standing wave is generated in the second antenna 40.

In this way, when the dielectric body 60 is provided, the standing wave is generated in the second antenna 40 by the reflected wave 45 of the electric field 44*a*. As a result, the second antenna 40 has the narrow band property as shown by the dashed line IIIB in FIG. 3.

When the reflected wave 45 is generated as shown in FIG. 5, a component of the electric field 44*a* perpendicular to the z-axis is compensated, and the vector sum of the remaining component perpendicular to the z-axis and z-axis component becomes a substantive electric field 47 radiated from the electric current that flows in the second helical part 41, that is, the traveling-wave current 43 and the reflected-wave current 46. Thus, in the direction perpendicular to the z-axis, the substantive electric field 47 is radiated toward a position closer to the second helical part 41 than the hypothetical electric field 44*a*. In this way, when the second antenna 40 operates, the main electric field 47 radiated from the electric current that flows in the second helical part 41 is trapped inside the dielectric body 60.

A difference between a reaching point of the hypothetical electric field 44*a* on the ground plane 20 and a reaching point of the substantive electric field 47 on the ground plane 20 increases with a distance of the one-turn portion from the ground plane 20.

Therefore, the inventors further studied so as to reduce the dimension and to broaden the band of the second antenna, specifically, to a band equal to or broader than a case without the dielectric body 60. The following embodiments are based on the study.

(First Embodiment)

In the following description, the same referential numbers are given to components same as or related to the components of the reference examples shown in FIG. 1 and FIG. 2. Definitions of directions are the same as the reference examples.

Regarding lengths and directions of antennas 30 and 40 (helical parts 31 and 41) described below, an expression does not mean only an exact expression but also means a rough expression. For example, a description of "2 times" means about 2 times, and description of "vertical direction" means an approximately vertical direction.

An antenna device 10 according to the present embodiment can be suitably used as an antenna device for short range communications. The antenna device for the short range communications includes an antenna device that is used in an intelligent transport system (ITS) for a two-way wireless communications in a small zone within a distance from a few meters to a few dozen meters, for example, for a Dedicated Short Range Communications (DSRC). The antenna device also includes an antenna device used for Wireless for the Vehicular Environment (WAVE) in the United States of America.

A center frequency of a radio wave used in the short range communications is 5.8 GHz in Japan and is 5.9 GHz in the United States of America. An infrastructure that performs a two-way communication with the antenna device for the short range communications includes a roadside device and an in-vehicle device (e.g., antenna) disposed in other vehicles.

In the present embodiment, the antenna device 10 is an antenna device for an electronic toll collection (ETC) system. The ETC is an example of the DSRC. The ETC is a system that automatically collects toll without stopping a vehicle by wireless communications between a roadside device (base station) installed in a toll station and an antenna device for the ETC disposed in a vehicle. The ETC (electronic toll collection system) is a Japanese registered trademark of Organization for Road System Enhancement.

Figure 6:
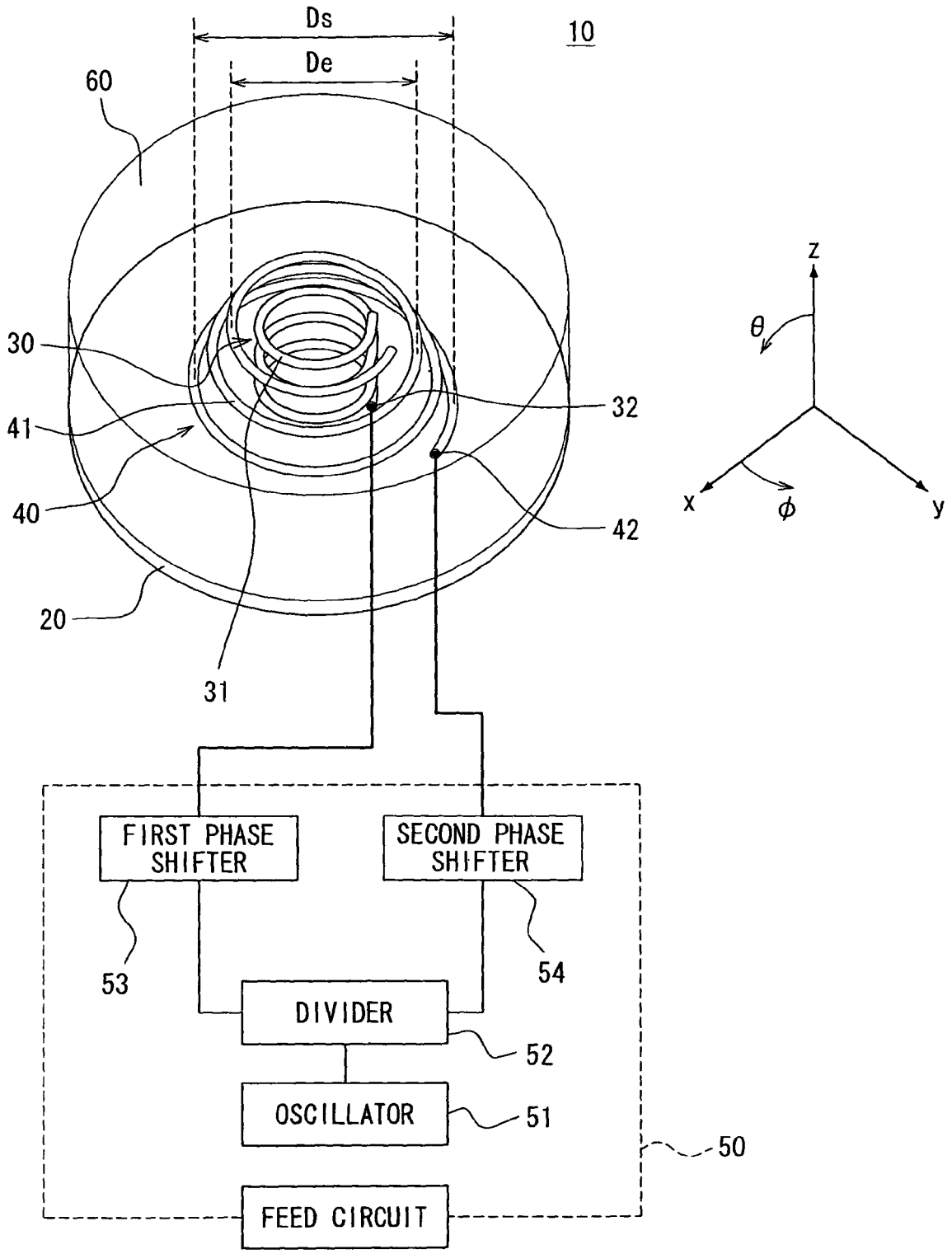
FIG. 6 is a diagram showing an antenna device according to a first embodiment of the present invention.

As shown in FIG. 6, the antenna device 10 according to the present embodiment has a structure similar to the antenna devices shown in FIG. 1 and FIG. 2.

The antenna device 10 includes a ground plane 20, that is, a reflecting plate, and a dielectric body 60 disposed on a surface of the ground plane 20. The ground plane 20 has a circular planar shape having a predetermined thickness. The dielectric body 60 has an approximately column shape. In a direction perpendicular to the z-axis direction, a diameter of the dielectric body 60 is substantially equal to a diameter of the surface of the ground plane 20. The dielectric body 60 may be made of resin or ceramic.

The antenna device 10 further includes a first antenna 30 and a second antenna 40. The first antenna 30 includes a first helical part 31 disposed in the dielectric body 60. The first helical part 31 is helically wound up in a direction perpendicular to the surface of the ground plane 20, that is, in the z-axis direction. Peripheral lengths of one-turn portions of the first helical part 31 are constant and M times a wavelength 2 of use, where M is a positive natural number. The second antenna 40 includes a second helical part 41 disposed in the dielectric body 60. The second helical part 41 is disposed outside of the first helical part 31 in the direction perpendicular to the axial direction of the first helical part 31 (the z-axis direction) so as to be away from the first helical part 31. In other words, in the direction perpendicular to the z-axis direction, the second helical part 41 surrounds the first helical part 31.

In the present embodiment, as an example, in a manner similar to the configuration shown in FIG. 1, each of the first helical part 31 and the second helical part 41 is wound so that a cross-sectional shape perpendicular to the axial direction (a planar shape of each one-turn portion perpendicular to the axial direction) is a circular shape. The second helical part 41 is disposed radially outside of the first helical part 31. The first antenna 30 and the second antenna 40 are arranged in such a manner that the axis of the first helical part 31 of the first antenna 30 and the axis of the second helical part 41 of the second antenna 40 pass through a center of the surface of the ground plane 20 having the circular shape. In other words, the first helical part 31 and the second helical part 41 are arranged approximately concentrically with respect to the center of the surface of the ground plane 20. Thus, in the direction perpendicular to the axial direction (the z-axis direction), a distance from the second helical part 41 of the second antenna 40 to an end portion of the ground plane 20 is substantially uniform in the whole circumference around the z-axis.

The antenna device 10 further includes a feed circuit 50 that supplies a high frequency signal (traveling-wave current) to each of the first antenna 30 and the second antenna 40. The feed circuit 50 includes an oscillator 51, a divider 52, a first phase shifter 53, and a second phase shifter 54. The divider 52 is coupled with the oscillator 51. The first phase shifter 53 is coupled with an output side of the divider 52 and a feeding point 32 of the first antenna 30. The second phase shifter 54 is coupled with an output side of the divider 52 and a feeding point 42 of the second antenna 40.

In the antenna device 10 having the above-described structure, the second helical part 41 of the second antenna 40 has a characteristic shape.

In the second helical part 41, a peripheral length Ks of a one-turn portion closest to the surface of the ground plane 20 is N times the wavelength λ of use, where N is a positive natural number greater than M. In any two consecutive one-turn portions, a peripheral length K1 of a first one-turn portion closer to the surface of the ground plane 20 and a peripheral length K2 of a second one-turn portion farther away from the surface of the ground plane 20 satisfy a relationship of $K1 \geq K2$. In addition, a peripheral length Ke of a one-turn portion farthest away from the surface of the ground plane 20 satisfies a relationship of $(M \cdot \lambda) < Ke < Ks\ (= N \cdot \lambda)$ In the present embodiment, as an example, the number of turns of each of the first helical part 31 and the second helical part 41 is three, and pitches of the first helical part 31 and the second helical part 41 are substantially equal to each other. Heights from the ground plane 20 to upper ends of the first helical part 31 and the second helical part 41 are also substantially equal to each other.

The peripheral length of each one-turn portion of the first helical part 31 is same as the wavelength λ of use (M=1). In the second helical part 41, the peripheral length Ks of the one-turn portion closest to the surface of the ground plane 20 is 2 times the wavelength λ of use (N=2). Thus, in the second helical part 41, a diameter Ds of the one-turn portion closest to the ground plane 20 is $2\lambda/(\pi \cdot \in^{1/2})$ as shown in FIG. 7.

Figure 7:
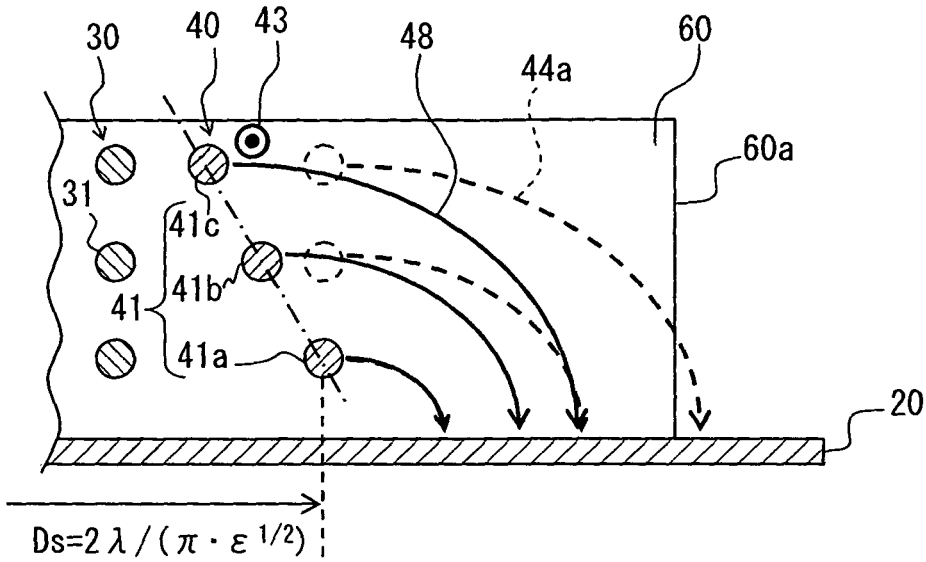
FIG. 7 is a schematic diagram showing an electric field generated at a second helical part in the antenna device shown in FIG. 6.

As shown in FIG. 6 and FIG. 7, the second helical part 41 is helically wound up into a taper shape in such a manner that the peripheral length of each one-turn portion decreases with a distance from the surface of the ground plane 20. In other words, the second helical part 41 is helically wound up into a taper shape in such a manner that diameter of each one-turn portion decreases with the distance from the surface of the ground plane 20.

As shown in FIG. 7, in the second helical part 41, the amount of change in the peripheral length of each one-turn portion is constant in the z-axis direction. In other words, the second helical part 41 has a linear taper shape. When three cross-sectional portions of the second helical part 41 shown in FIG. 7 are referred to as a first one-turn portion 41*a*, a second one-turn portion 41*b*, and a third one-turn portion 41*c* from a side close to the ground plane 20, the peripheral length of the first one-turn portion 41*a* is Ks and the peripheral length of the third one-turn portion 41*c* is Ke. When the peripheral length of the second one-turn portion 41*b* is Km, the peripheral lengths Ks, Km, and Ke satisfy a relationship of $Ks > Km > Ke$. In addition, a difference (Ks−Km) between the peripheral lengths of the first one-turn portion 41*a* and the second one-turn portion 41*b* is equal to a difference (Km−Ke) between the peripheral lengths of the second one-turn portion 41*b* and the third one-turn portion 41*c*.

Thus, in the second helical part 41, the diameter De of the one-turn portion farthest away from the surface of the ground plane 20 is smaller than the diameter Ds of the one-turn portion closest to the surface of the ground plane 20 and is larger than the diameter of the first helical part 31. Also in FIG. 7, a hatching that indicates the cross section of the dielectric body 60 is not illustrated to improve understanding of an electric field 48, the first helical part 31, and the second helical part 41.

A reason why the second antenna 40 in the antenna device 10 can have a wide band will be described. In FIG. 7, the second helical part 41 and the electric field 44*a* radiated from the traveling-wave current 43 that flows in the second helical part 41 shown in FIG. 5 are shown by dashed lines as a comparative example.

When the traveling-wave current flows in the second antenna 40, an electric field is radiated from the traveling-wave current that flows in second helical part 41. A main electric field 48 radiated from the traveling-wave current 43 is shown by solid arrows in FIG. 7.

In the antenna device 10 according to the present embodiment, the second helical part 41 is helically wound up into a taper shape in such a manner that the peripheral length of each one-turn portion decreases with the distance from the ground plane 20. Thus, a distance from the second helical part 41 to a boundary between the dielectric body 60 and air, that is, a distance from the second helical part 41 to the sidewall 60*a* of the dielectric body 60 increases with the distance from the ground plane 20 in the z-axis direction. If the peripheral length Ks of the one-turn portion closest to the ground plane 20 is the same, that is, if the diameter Ds of the one-turn portion closest to the ground plane 20 is the same, a distance from the second one-turn portion 41*b* to the sidewall 60*a* of the dielectric body 60 and a distance from the third one-turn portion 41*c* to the sidewall 60*a* of the dielectric body 60 are longer than those of the second helical part 41 (dashed lines in FIG. 7) that is wound up so as to have a constant peripheral length.

Thus, the electric field 48 radiated from the traveling-wave current 43 that flow in the one-turn portions 41*a*-41*c*, in particular, the electric field 48 radiated from the traveling-wave current 43 that flows in the second one-turn portion 41*b* and the third one-turn portion 41*c* reach the surface of the ground plane 20 before being reflected at the boundary between the dielectric body 60 and air.

Figure 8:
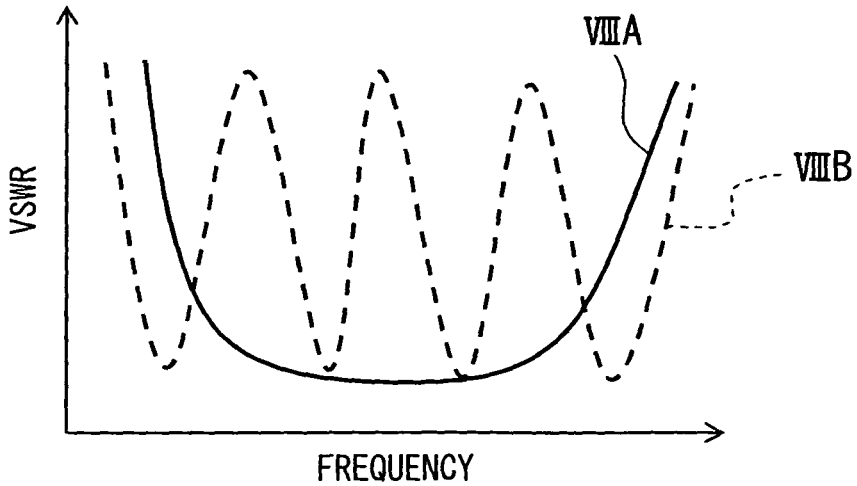
FIG. 8 is a graph showing a relationship between a frequency and a voltage stating wave ratio of the antenna device shown in FIG. 6.

In the antenna device 10 according to the present embodiment, a reflection of the electric field radiated from the traveling-wave current 43 at the boundary between the dielectric body 60 and air can be reduced. Thus, the main electric field 48 that is similar to the main electric field 44 in the configuration without the dielectric body 60 can be secured. Furthermore, because the reflection can be reduced, generation of a standing wave of the second antenna 40 can be restricted. As a result, as shown by the solid line VIIIA, the band of the second antenna 40 can be broad band similar to the configuration without the dielectric body 60, which is shown by the solid line IIIA in FIG. 3. In FIG. 8, as a comparative example, a band of the second antenna 40 in the antenna device 10 shown in FIG. 2, that is, a band in a configuration that includes the dielectric body 60 and the second helical part 41 without a taper is shown by the dashed line VIIIB.

As described above, in the antenna device 10 according to the present embodiment, due to the wavelength shortening effect of the dielectric body 60, the dimension of the second antenna 40 in the direction perpendicular to the z-axis direction can be $1/\in^{1/2}$ times the dimension of the configuration without the dielectric body 60. The second helical part 41 of the second antenna 40 is disposed outside of the first helical part 31 of the first antenna 30, and the dimensions of the first antenna 30 and the second antenna 40 depend on the dimension of the second antenna 40. Thus, due to the above-described wavelength shortening effect, the dimensions of the first antenna 30 and the second antenna 40, eventually, the dimension of the antenna device 10 can be reduced compared with the configuration without the dielectric body 60.

In addition, by forming the second helical part 41 into the taper shape, narrowing of the band of the second antenna 40 can be reduced while reducing the dimension. The antenna device 10 according to the present embodiment includes the two axial-mode helical antennas, that is, the first antenna 30 and the second antenna 40, and the directivities of the main beam in the $\phi$ direction and the $\theta$ direction are controlled with the phases and the strengths of the high frequency signals input to the first antenna 30 and the second antenna 40. Thus, by restricting the narrowing of the band of the second antenna 40, narrowing of the band of the main beam can also be restricted.

Accordingly, even when there is variation among products, the wavelength $\lambda$ of use can be included in the band of the second antenna 40. Therefore, the first antenna 30 and the second antenna 40 can stably operate with the wavelength $\lambda$ of use.

In addition, as described above, when the peripheral length of each one-turn portion of the first helical part 31 is equal to the wavelength $\lambda$ of use (M=1), and the peripheral length Ks of the one-turn portion 41*a* of the second helical part 41 closest to the ground plane 20 is 2 times the wavelength $\lambda$ of use (N=2), the dimensions of the first antenna 30 and the second antenna 40 can be smallest with respect to the wavelength $\lambda$ of use.

(Second Embodiment)

Figure 9:
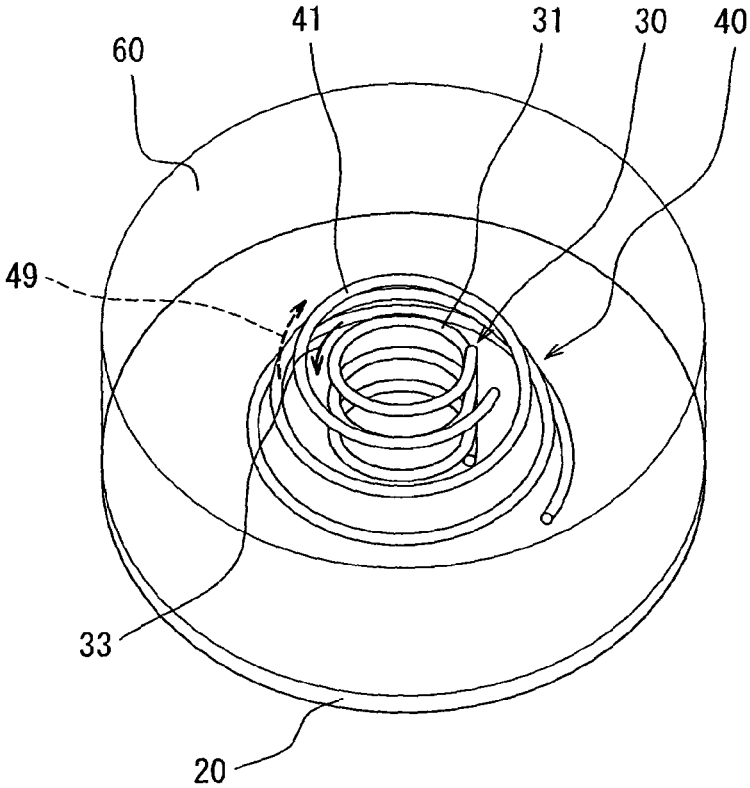
FIG. 9 is a diagram showing an image current induced in the second helical part.

In the second helical part 41 according to the above-described embodiment, a distance between the first helical part 31 and the second helical part 41 decreases with a distance from the surface of the ground plane 20 in the z-axis direction. Thus, at the one-turn portion of the second helical part 41 further away from the ground plane 20 in the z-axis direction, interaction between the first antenna 30 and the second antenna is easily produced. For example, as shown in FIG. 9, image current 49 opposite to the traveling-wave current 33 is caused in the second helical part 41 by the traveling-wave current 33 that flows in the first helical part 31, and the image current increases with decrease of the distance between the first helical part 31 and the second helical part 41. Thus, a gain of a beam radiated from the first antenna 30 toward the surface of the ground plane 20 is reduced.

The present inventors simulated a shape of the second helical part 41 so that the band of the second antenna 40 can be equal to or broader than the configuration without the dielectric body 60 (see FIG. 1 and FIG. 4) and an antenna gain of the first antenna 30 can be similar to the configuration including the second helical part 41 having a constant peripheral length (see FIG. 2 and FIG. 5).

The configuration used for the simulation is same as the configuration described in the first embodiment. Specifically, the number of tunes of each of the first helical part 31 and the second helical part 41 is three, and the pitches of the first helical part 31 and the second helical part 41 are substantially equal to each other. The heights from the ground plane 20 to the upper ends of the first helical part 31 and the second helical part 41 are substantially equal to each other.

The peripheral length of each one-turn portion of the first helical part 31 is equal to the wavelength $\lambda$ of use (M=1), and the peripheral length Ks of the one-turn portion 41*a* of the second helical part 41 closest to the ground plane 20 is 2 times the wavelength $\lambda$ of use. In other words, the diameter Ds of the one-turn portion 41*a* of the second helical part 41 closest to the ground plane 20 is $2\lambda/(\pi\cdot\in^{1/2})$.

Figure 10:
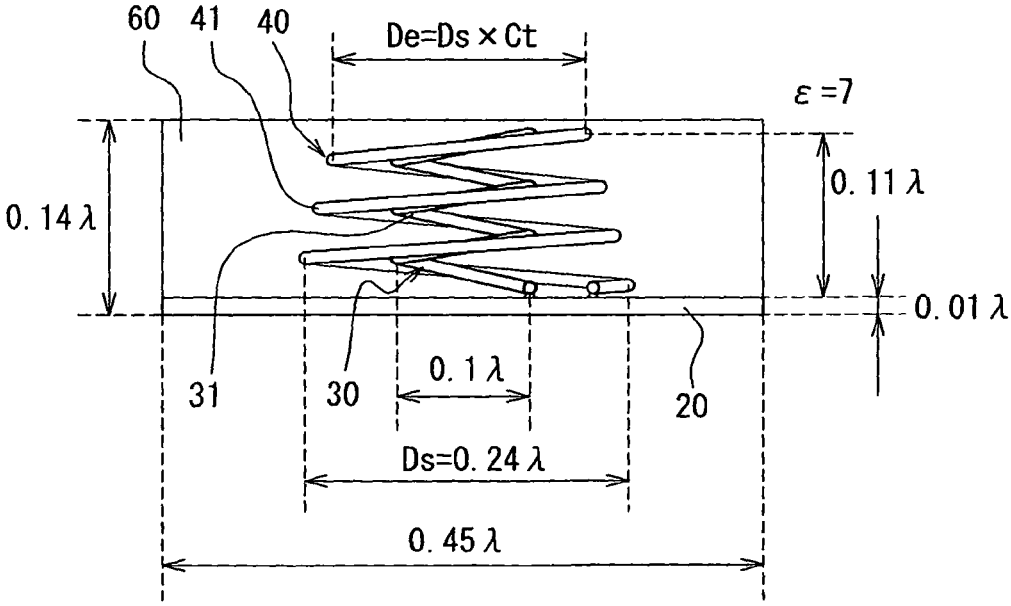
FIG. 10 is a diagram showing an antenna device used for a simulation.

Specifically, as shown in FIG. 10, the directivity $\in$ of the dielectric body 60 is set to 7. In the z-axis direction, the thickness of the ground plane 20 is $0.01\lambda$, the heights of the first helical part 31 and the second helical part 41 are $0.11\lambda$, a thickness of a rear surface of the ground plane 20 to a surface of the dielectric body 60 is $0.14\lambda$.

In addition, in the direction perpendicular to the z-axis, the diameter of the first helical part 31 is $0.1\lambda$, which is substantially equal to $\lambda/(\pi\cdot\in^{1/2})$, the diameter Ds of the second helical part 41 is $0.24\lambda$, which is substantially equal to $2\lambda/(\pi\cdot\in^{1/2})$, and the diameter of the ground plane 20 is $0.45\lambda$, which is about 2 times the diameter Ds.

Furthermore, in the second helical part 41 having the taper shape, the amount of change in the peripheral lengths of the one-turn portions is constant in the z-axis direction, and the diameter De of the one-turn portion 41*c* farthest away from the ground plane 20 is Ds×taper coefficient Ct. That is, when the taper coefficient Ct is 1.0, the peripheral length of each one-turn portion is constant, that is, the diameter D is constant at Ds. The taper coefficient Ct corresponds to a ratio (De/Ds).

Figure 11:
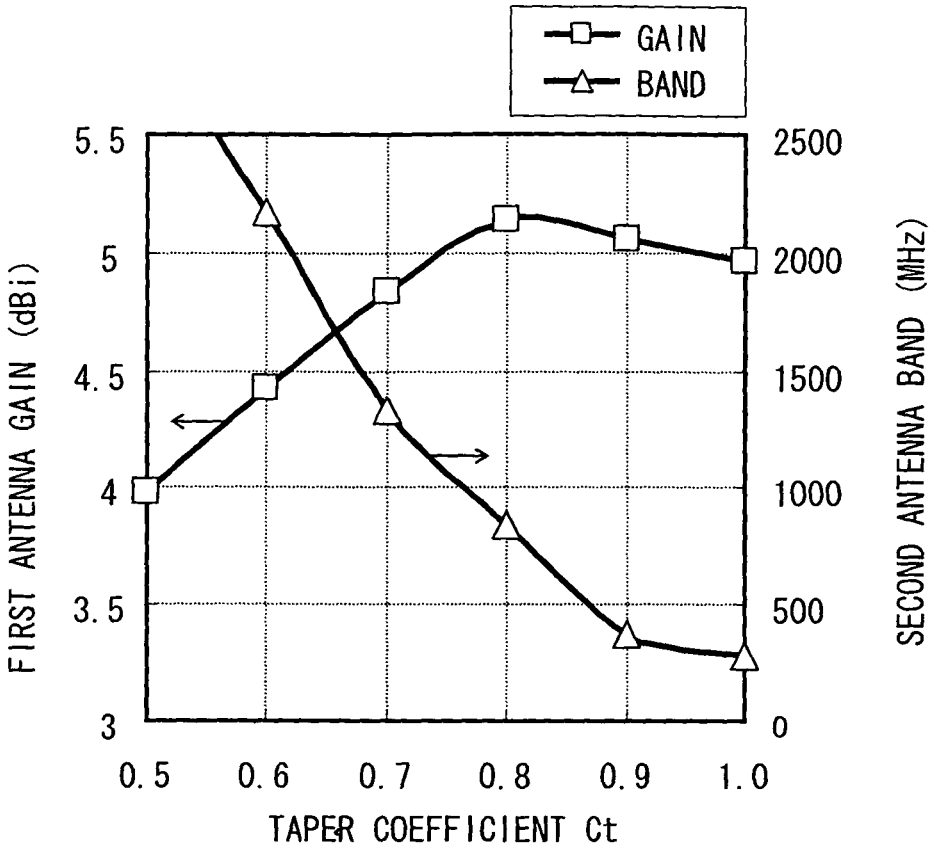
FIG. 11 is a graph showing a relationship between a taper coefficient and a gain of a first antenna and a relationship between the taper coefficient and a band of a second antenna.

A relationship between the taper coefficient Ct and the antenna gain of the first antenna 30, and a relationship between the taper coefficient Ct and the band of the second antenna 40 are shown in FIG. 11.

In FIG. 1, squares show the gain of the first antenna 30 and triangles show the band of the second antenna 40. The taper coefficient Ct is changed from 0.5 to 1.0 by 0.1.

When the second helical part 41 has a constant peripheral length, when the taper coefficient Ct is 1.0, the gain of the first antenna 30 is about 5 dBi as shown in FIG. 11. When the taper coefficient Ct is not less than 0.7 and is less than 1.0, the gain of the first antenna 30 is comparable (5±0.25 dBi) to the antenna gain of the first antenna 30 when the taper coefficient Ct is 1.0.

When the second helical part 41 has the constant peripheral length, that is, when the taper coefficient Ct is 1.0, as shown in FIG. 11, the band of the second antenna 40 is about 250 MHz. When the dielectric body 60 is not provided in the configuration shown in FIG. 10 (see FIG. 1 and FIG. 4), the band of the second antenna 40 is about 900 MHz. When the taper coefficient Ct is equal to or less than 0.8 (in FIG. 11, not less than 0.5), the band of the second antenna 40 is equal to or broader the band of the second antenna 40 without the dielectric body 60.

When the ratio (De/Ds) of the diameter Ds of the one-turn portion closest to the ground plane 20 and the diameter De of the one-turn portion 41*a* furthest away from the ground plane 20, that is, the taper coefficient Ct is in a range from 0.7 to 0.8, the band of the second antenna 40 can be comparable to the configuration without the dielectric body 60, and the antenna gain of the first antenna 30 can be comparable to the configuration that includes the dielectric body 60 and the second helical part 41 having a constant peripheral length.

(Other Embodiments)

Although the present invention has been fully described in connection with the preferred embodiments thereof with reference to the accompanying drawings, it is to be noted that various changes and modifications will become apparent to those skilled in the art.

In the above-described embodiments, the peripheral length of each one-turn portion of the first helical part 31 is equal to the wavelength λ of use (M=1), and the peripheral length Ks of the one-turn portion 41*a* of the second helical part 41 closest to the ground plane 20 is 2 times the wavelength λ of use as an example. The antenna device 10 may be configured so that at least the peripheral length of each one-turn portion of the first helical part 31 is M times the wavelength λ of use, where M is the positive natural number, and the peripheral length Ks of the one-turn portion 41*a* of the second helical part 41 closest to the ground plane 20 is N times the wavelength λ of use, where N is the natural number greater than M.

Figure 12:
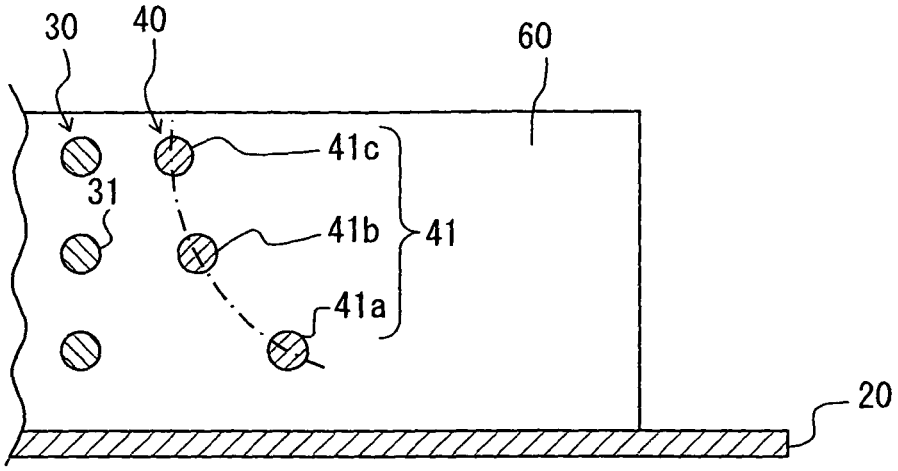
FIG. 12 is a diagram showing a part of an antenna device according to another embodiment of the present invention.

In the above-described embodiments, as an example of the second helical part 41 that is formed into a taper shape in such a manner that the peripheral length of each one-turn portion decreases with the distance from the ground plane 20, the amount of change in the peripheral length is constant in the z-axis direction. In a second helical part 41 according to another embodiment of the present embodiment, the amount of change in the peripheral length of each one-turn portion decreases with a distance from the ground plane 20 in the z-axis direction as shown in FIG. 12. In the present case, a difference (Ks−Km) between the peripheral lengths of the first one-turn portion 41*a* and the second one-turn portion 41*b* is greater than a difference (Km−Ke) between the peripheral lengths of the second one-turn portion 41*b* and the third one-turn portion 41*c*. Also in FIG. 12, a hatching that indicates the cross section of the dielectric body 60 is not illustrated to improve understanding of the first helical part 31 and the second helical part 41.

Although it is not shown, a second helical part 41 that is formed into a taper shape in such a manner that the amount of change in the peripheral length of each one-turn portion increases with a distance from the ground plane 20 may also be used.

Furthermore, a second helical, part 41 may also include a section where the peripheral length of each one-turn portion decreases with a distance from the ground plane 20 and a section where the peripheral length of each one-turn portion is a constant. In other words, the second helical part 41 may also include a section where the peripheral length of each one-turn portion is not changed.

Figure 13:
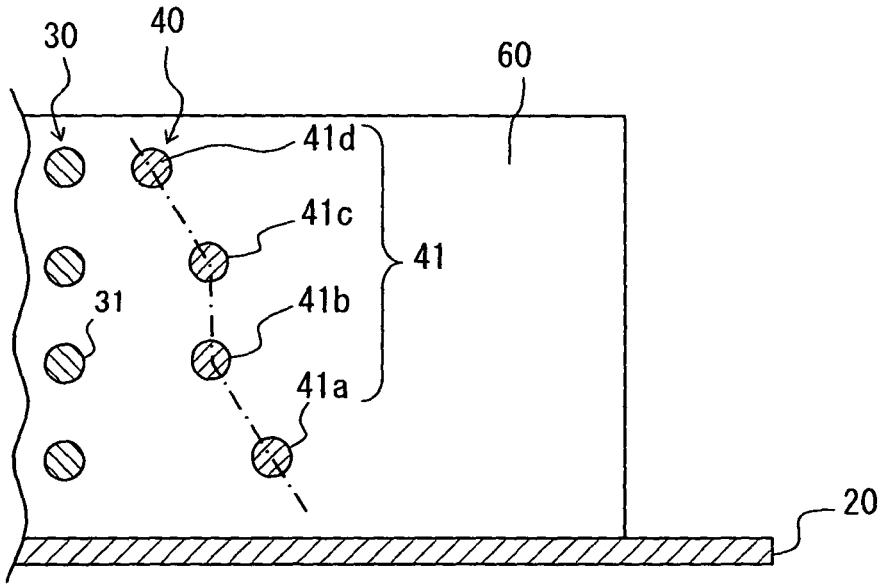
FIG. 13 is a diagram showing a part of an antenna device according to another embodiment of the present invention.

A second helical part 41 according to another embodiment of the present invention includes a first one-turn portion 41*a*, a second one-turn portion 41*b*, a third one-turn portion 41*c*, and a fourth one-turn portion 41*d* from a side close to the ground plane 20 as shown in FIG. 13. In the present case, the peripheral length of the first one-turn portion 41*a* is Ks, and the peripheral length of the fourth one-turn portion 41*d* is Ke. When the peripheral length of the second one-turn portion 41*b* is Km1, and the peripheral length of the third one-turn portion 41*c* is Km2, Km1 is equal to Km2. In addition, the peripheral lengths Ks, Km1, Km2, and Ke satisfy a relationship of Ks>Km1=Km2>Ke. Also in the present configuration, the band of the second antenna 40 can be broaden compared with the conventional second helical part 41 that has a constant peripheral length. Also in FIG. 13, a hatching that indicates the cross section of the dielectric body 60 is not illustrated to improve understanding of the first helical part 31 and the second helical part 41.

Although the peripheral length Km1 of the second one-turn portion 41*b* is equal to the peripheral length Km2 of the third one-turn portion 41*c* in the example shown in FIG. 13, a plurality of consecutive the one-turn portions having the same peripheral length is not limited to the above-described example. For example, the peripheral length of the first one-turn portion 41*a* may also be equal to the peripheral length of the second one-turn portion 41*b*, or the peripheral length of the third one-turn portion 41*c* may also be equal to the peripheral length of the fourth one-turn portion 41*d*.

In the above-described embodiments, the cross-sectional shape (the plane shape of each one-turn portion in a direction perpendicular to the z-axis direction) of each of the first helical part 31 and the second helical part 41 is a circular shape. However, the cross-sectional shape of each of the first helical part 31 and the second helical part 41 is not limited to the circular shape and may also be a polygonal shape. In such a case, the plane shape of the ground plane 20 may be similar to the cross-sectional shapes of the first helical part 31 and the second helical part 41, and axes of the first helical part 31 and the second helical part 41 may pass through the center of the surface of the ground plane 20. In the present case, the distance between the second helical part 41 and the end portion of the ground plane 20 can be substantially constant in the whole periphery around the axis.

In the present embodiment, the first helical part 31 and the second helical part 41 are fully buried in the dielectric body 60. However, for example, in the z-axis direction, a section of each of the helical parts 31 and 41 closest to the ground plane 20 may also be buried in the dielectric body 60, and the other section of each of the helical parts 31 and 41 on the opposite side from the feeding points 32 and 42 may also be exposed outside from the dielectric body 60.

In the first embodiment and the second embodiment, the number of turns of each of the first helical part 31 and the second helical part 41 is three. However, the number of turns is not limited to the above-described examples.

What is claimed is:

1. An antenna device comprising:

a ground plane having a surface;

a dielectric body disposed on the surface of the ground plane;

a first antenna including a first helical part disposed in the dielectric body, the first helical part helically wound up in an axial direction perpendicular to the surface of the ground plane, the first helical part including a plurality of one-turn portions each having a peripheral length of M times a wavelength λ of use, where M is a positive natural number;

a second antenna including a second helical part disposed in the dielectric body, the second helical part disposed outside the first helical part in a direction perpendicular to the axial direction so as to be away from the first helical part, the first helical part wound up along the axial direction;

a feeding circuit including an oscillator, a divider coupled with the oscillator, a first phase shifter coupled with the divider and a feeding point of the first antenna, and a second phase shifter coupled with the divider and a feeding point of the second antenna, wherein the second helical part includes a plurality of one-turn portions, one of the plurality of one-turn portions of the second helical part closest to the surface of the ground plane has a peripheral length Ks that is N times the wavelength λ of use, where N is a positive natural number greater than M, in consecutive two of the plurality of one-turn portions of the second helical part, a first one closer to the surface of the ground plane has a peripheral length K1, a second one farther away from the surface of the ground plane has a peripheral length K2, and the peripheral lengths K1 and K2 satisfy a relationship of $K1 \geq K2$, and one of the plurality of one-turn portions of the second helical part farthest away from the surface of the ground plane has a peripheral length Ke that satisfies a relationship of $(M \cdot \lambda) < Ke < Ks (= N \cdot \lambda)$.

2. The antenna device according to claim 1, wherein the second helical part is helically wound up into a taper shape in such a manner that the peripheral length of each of the plurality of one-turn portions decreases with a distance from the surface of the ground plane.

3. The antenna device according to claim 1, wherein the second helical part includes a first section where the peripheral length of each of the plurality of one-turn portions decreases with a distance from the surface of the ground plane and a second section where the peripheral lengths of consecutive two of the plurality of one-turn portions are equal to each other.

4. The antenna device according to claim 2, wherein the second helical part is helically wound up into the taper shape in such a manner that the amount of change in the peripheral length of each of the plurality of one-turn portions is constant in the direction perpendicular to the surface of the ground.

5. The antenna device according to claim 1, wherein the peripheral length of each of the plurality of one-turn portions of the first helical part is equal to the wavelength λ of use, and the peripheral length Ks of the one of the plurality of one-turn portions of the second helical part closest to the ground plane is 2 times the wavelength λ of use.

6. The antenna device according to claim 1, wherein each of the first helical part and the second helical part has a circular cross section perpendicular to the axial direction, and the second helical part is disposed radially outside of the first helical part.

7. The antenna device according to claim 6, wherein the one of the plurality of one-turn portions of the second helical part closest to the surface of the ground plane has a diameter Ds, the one of the plurality of one-turn portions of the second helical part farthest away from the surface of the ground plane has a diameter De, and a ratio De/Ds is within a range from 0.7 to 0.8.

* * * * *